United States Patent [19]

Loreal

[11] 4,391,462

[45] Jul. 5, 1983

[54] ANTI-THEFT LOCKING DEVICE ADAPTABLE TO CONTAINERS

[75] Inventor: Guy Loreal, Teteghem, France

[73] Assignee: Societe Navale Chargeurs Delmas-Vieljeux, France

[21] Appl. No.: 288,831

[22] Filed: Jul. 31, 1981

[30] Foreign Application Priority Data

Aug. 8, 1980 [FR] France ..... 80 17553

[51] Int. Cl.[3] ..... E05C 3/04

[52] U.S. Cl. ..... 292/207; 292/218

[58] Field of Search ..... 220/1.5; 292/183, 189, 292/207, 218

[56] References Cited

U.S. PATENT DOCUMENTS 1,757,916 5/1930 Modo ..... 292/207 X 1,916,650 7/1933 Beauchamp ..... 292/189 X 4,057,170 11/1977 Dougherty ..... 292/218 X 4,341,495 7/1982 Del'Acgua ..... 220/1.5 X

*Primary Examiner*—Richard E. Moore

*Attorney, Agent, or Firm*—William A. Drucker

[57] ABSTRACT

The anti-theft device comprises essentially a movable vertical plate extending through an opening formed in the rain-strap overlying the doors of the container; this plate is adapted to drop by gravity to a position in which it is located behind lug extensions of the upper ends of the lock rods associated with each door panel to prevent the opening movement of the rods as long as the movable plate is not raised to a position overlying the lugs, this movable plate being rigid with a horizontal cover plate disposed on top of the container and prevented from being raised to a height sufficient for releasing the rods by another stacked container.

4 Claims, 8 Drawing Figures

ANTI-THEFT LOCKING DEVICE ADAPTABLE TO CONTAINERS

BACKGROUND OF THE INVENTION

The present invention relates in general to containers of the type utilized for transporting goods on ships, cargos, railway cars, trucks and other vehicles.

Standard containers are now available throughout the world for transporting goods notably by sea, which have their hingedly mounted doors or panels held in a water-proof closed condition by bolts consisting of vertical rods adapted to pivot about their axes, carried by the door leaves in bearings rigid with said leaves and provided at their ends with so-called cam members adapted, when the bolts are rotated, to cooperate with fixed keepers or like members provided on the door frames in order to keep the doors closed in a predetermined angular position of the bolts and to release sais doors in another angular position. Each bolt is actuated by causing a control arm normally engaging the outer surface of the door in its closed position to pivot in a horizontal plane.

However, the goods enclosed in containers of this type are liable to be stolen either on board transport ships or when the containers are stored in a parking place, for example at the terminal station of a transport line.

SUMMARY OF THE INVENTION

It is the primary object of the present invention to prevent the undesired opening of the doors of standard containers, especially when the containers are stacked on one another, by providing a device associated with the containers' doors and such as to prevent the actuation of the bolts, said device being so designed that it is unnecessary to bring any modification in the construction norms of existing containers and impair the containers' water-tightness, the device forming an integral part of the container without resorting to any detachable component element likely to be lost.

The principle of the invention consists in providing an anti-theft device comprising a movable vertical locking plate engaging a rain-strap opening formed through a horizontal plate overlying the doors of the container, said plate being adapted to slide by gravity to a locking position behind depending extensions of the bolt ends and thus prevent the undesired opening movement of the bolts as long as the vertical plate is not lifted to a position overlying said extensions, said vertical plate being rigid with a horizontal plate disposed on top of the container roof and prevented from moving to a sufficient, bolt-releasing height as long as another container rests upon the container concerned in the stacked position.

The rain-strap aperture through which said vertical locking plate is adapted to slide may be formed in a fixed member welded to the upper longitudinal member of the container and to the roof or top thereof, and this fixed member may if desired be rigid with fixed guide members underlying the rain-strap aperture so as to act as slideways with respect to the side edges of the vertical locking plate. The movable plate may carry at a locating underlying the rain-strap aperture one or a plurality of retaining projections whereby the plate cannot be disconnected from the container.

A clearer understanding of the present invention will be had as the following description of a preferred embodiment thereof proceeds with reference to the accompanying drawings.

THE DRAWINGS

DESCRIPTION OF THE PREFERRED EMBODIMENT

Figure 1:
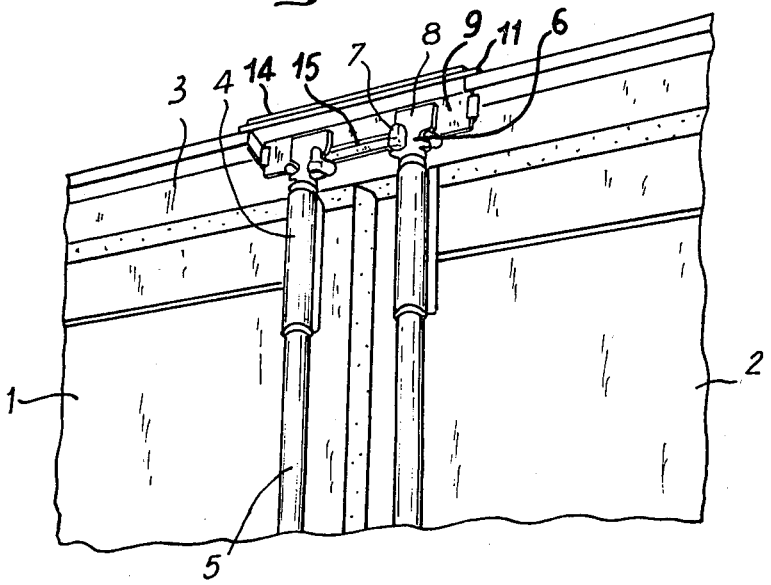
FIG. 1 is a fragmentary perspective view showing the upper ends of a pair of adjacent bolts in their closed position, each bolt being rotatably mounted on one of the door panels of a container equipped with the anti-theft locking device of this invention.
Figure 3:
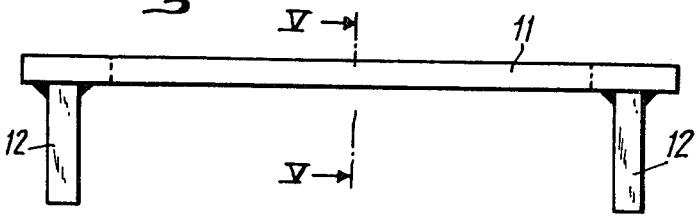
FIGS. 3, 4 and 5 are elevational view, a plane view from above and a horizontal section taken along the line V—V of FIG. 3, respectively, showing the main fixed member of the device.
Figure 5:
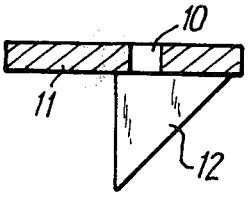
Figure 4:
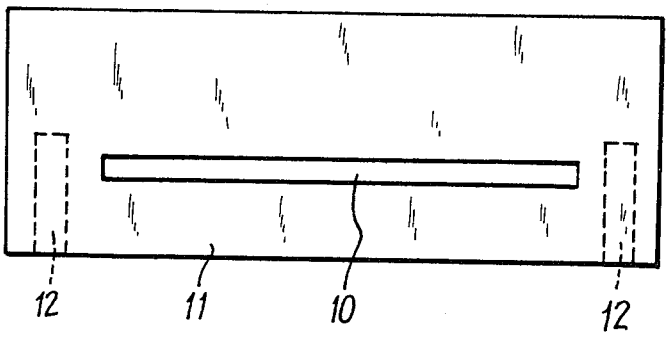
Figure 2:
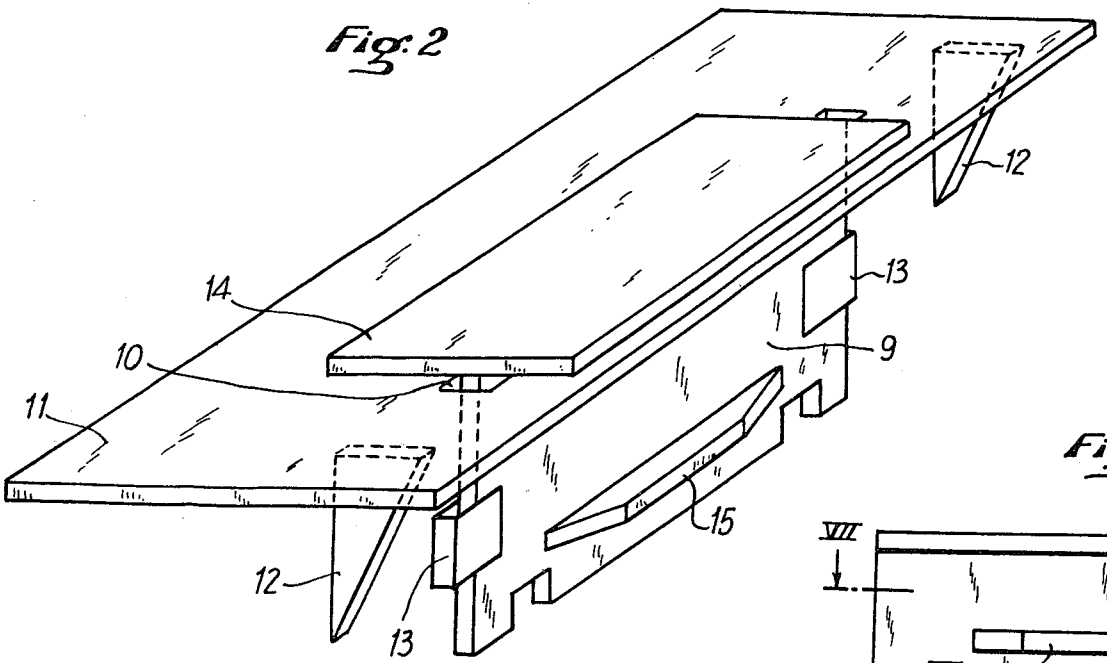
FIG. 2 is a perspective view of the locking device of this invention.
Figure 6:
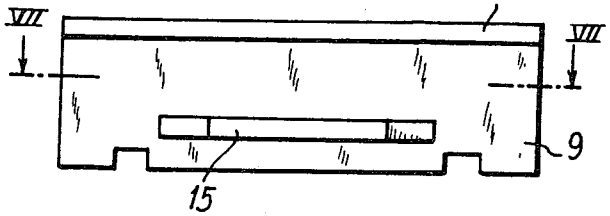
FIGS. 6, 7 and 8 are an elevational view, a horizontal section taken along the line VII—VII of FIG. 6 and a side elevational view of the movable member.
Figure 7:
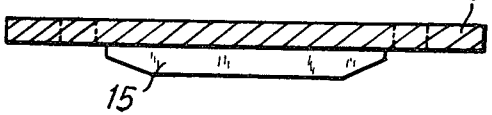
Figure 8:
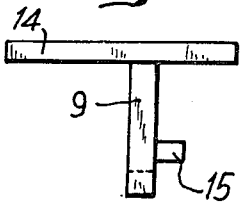

In FIG. 1, the reference numerals 1 and 2 designate the two door panels of a container, which are adapted to close in a water-tight manner the container by mutual engagement and with respect to a fixed door frame 3. According to the conventional arrangement, the right-hand door carries elements which, in the closed position, overlap the left-hand door. Each door panel 1, 2 is provided with vertical bearings 4 in which vertical rods 5 are adapted to rotate about their longitudinal axes; each rod 5 comprises a shaped end bolt 6 adapted to cooperate with a keeper 7 rigid with the fixed frame 3. According to the conventional arrangement characterising standard containers, each door panel having its hinge means disposed adjacent one end of the front face of the container carries externally a pair of vertical rods each actuated by an arm movable in a horizontal plane and adapted to be folded back against the outer surface of the door panel when the latter is closed.

In this door panel position, with the rods moved to their locking angular position, the end bolts 6 engage the rear face of the fixed keepers 7 and when the rods 5 and their end bolts 6 are rotated to their release or open-door positions the bolts 6 escape from keepers 7.

This invention is advantageously applicable to the upper end portions of the pair of adjacent rods mounted on the two door panels to be protected against any unlawful opening; however, it would not constitute a departure from the basic principle of the invention to limit the application thereof to the rod adjacent to the opening edge of the right-hand door panel since this edge normally overlaps the adjacent edge of the left-hand door panel when the latter is closed, so that this left-hand panel cannot be opened unless the right-hand door panel is open.

In the preferred and exemplary form of embodiment illustrated in the drawings, each one of the above-described adjacent rods 5 comprises an upper extension in the form of a flat lug 8 which, in the closed door position, is parallel to the front wall of the container but slightly spaced from the door frame 3 to permit the insertion of a movable vertical plate 9 between this frame 3 and the lugs 8 whereby the rods 5 cannot be rotated to their release or door-opening position unless this plate 9 is raised to a level above said lugs 8.

As already explained in the foregoing, the movable vertical plate 9 engages a rain strap opening 10 formed in a direction parallel to the front face of the container through a plate 11 secured by welding to the upper longitudinal member of the container frame and also to the top thereof, so as to overly the pair of rods 5. This horizontal plate 11 may be rigidly connected to a pair of triangular perpendicular side gussets 12.

The fixed members may also include a pair of lateral slides 13 adapted to be slidably engaged by the side edges of the vertical movable plate 9.

The movable plate 9 is rigid with a horizontal top plate 14 adapted to bear flat on the top surface of the fixed horizontal plate 11. In the specific form of embodiment illustrated the front face of the movable plate 9 is provided with a horizontal projecting rib 15 preventing the plate 9 from being lifted off the fixed plate 11 and thus releasing the rods 5. However, the permissible upward movement of plate 9 should be sufficient to clear the lugs 8 and, according to a specific feature of the present invention, these lugs 8 extend upward to a distance sufficient to prevent the lifting of plate 9 when the corresponding container receives another stacked container on its top, irrespective of the thickness of the sole-pieces utilized at the corners between adjacent containers when the latter are stacked.

It is obvious that the specific form of embodiment described hereinabove and illustrated in the accompanying drawings is given by way of example, not of limitation, and that several changes and modifications could be brought thereto without departing from the basic principles of the invention as will be readily understood by those conversant with the art.

What I claim is:

1. In a container presenting hingedly mounted doors maintained in tight-sealing closure position by at least one rotating vertical rod provided at its ends with locking members engaging fixed stops of the door frame, an anti-theft locking device which comprises:

a rain-strap opening provided in a front extension of the container roof in the vicinity of the upper end of said rotating vertical rod, a lug-shaped upper extension of the rotating vertical rod being placed in front of an upper portion of the door frame and providing, in the closure position of the rotating vertical rod, a free space in relation with said door frame, and a vertically movable plate engaging said rain-strap opening and moving downwards by gravity to lodge into the free space between said upper extension of the rotating vertical rod and said supper portion of the door frame, whereby the rotating vertical rod can be released to open the doors only when said movable plate has been raised sufficiently, this upward movement of the movable plate being normally prevented in any container supporting another, stacked container, by this other container.

2. Anti-theft device for container according to claim 1, wherein said vertically movable plate is rigid with a horizontal plate overlying the top of the container to limit the downward movement of said movable plate.

3. Anti-theft device for container according to claim 1, wherein said movable plate comprises on its outer face extending at a level below that of the opening in which said plate is adapted to slide, at least one projection to prevent the removal of said movable plate from the opening and furthermore likely to facilitate the upward movement of the movable plate which is necessary for releasing the rotating vertical rods to open the doors.

4. Anti-theft device for container according to claim 1, wherein the lateral edges of said movable plate are adapted to slide in fixed guiding slideways of the door frame which are provided beneath said rain-strap opening through which said movable plate is engaged.

* * * * *